US007780255B2

(12) United States Patent
Niekawa

(10) Patent No.: US 7,780,255 B2
(45) Date of Patent: Aug. 24, 2010

(54) PHASE CONTROLLED, MULTI-PASS INKJET RECORDING APPARATUS AND METHOD

(75) Inventor: Yukihiro Niekawa, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 627 days.

(21) Appl. No.: 11/199,414

(22) Filed: Aug. 8, 2005

(65) Prior Publication Data

US 2006/0033765 A1 Feb. 16, 2006

(30) Foreign Application Priority Data

Aug. 11, 2004 (JP) ..... 2004-234719

(51) Int. Cl.
*B41J 29/38* (2006.01)
*B41J 2/01* (2006.01)

(52) U.S. Cl. ..... 347/12; 347/11; 347/102

(58) Field of Classification Search ..... 347/12, 347/41

See application file for complete search history.

(56) References Cited

U.S. PATENT DOCUMENTS

| | | | | |
|---|---|---|---|---|
| 5,952,401 | A | 9/1999 | Kimura et al. | |
| 6,257,690 | B1 * | 7/2001 | Holstun | 347/12 |
| 6,338,544 | B1 * | 1/2002 | Drake et al. | 347/12 |
| 6,478,396 | B1 * | 11/2002 | Schloeman et al. | 347/12 |
| 6,523,926 | B1 * | 2/2003 | Mitsuzawa et al. | 347/19 |
| 6,547,355 | B1 * | 4/2003 | Shimada et al. | 347/12 |
| 6,669,330 | B2 * | 12/2003 | Vanhooydonck et al. | 347/41 |
| 6,715,853 | B2 * | 4/2004 | Berkoben et al. | 347/19 |
| 2002/0101465 | A1 * | 8/2002 | Maeda | 347/12 |
| 2003/0184632 | A1 * | 10/2003 | Suzuki et al. | 347/102 |
| 2004/0051747 | A1 | 3/2004 | Nunokawa et al. | |

FOREIGN PATENT DOCUMENTS

| | | | |
|---|---|---|---|
| JP | 7-224241 | | 8/1995 |
| JP | 2002248810 A | * | 9/2002 |
| JP | 2003-320653 | | 11/2003 |

* cited by examiner

*Primary Examiner*—Matthew Luu
*Assistant Examiner*—Shelby Fidler
(74) *Attorney, Agent, or Firm*—Lucas & Mercanti, LLP

(57) ABSTRACT

An inkjet recording apparatus having a recording head unit having nozzle lines driven with multi-phase drive, a moving unit to move the recording head unit in a scanning direction crossing the nozzle lines, a clock generating unit, and a recording head control section. The recording head control section includes a phase control section to control each drive phase of the nozzle lines on the basis of the clock signals, and controls the recording head unit such that, by driving the nozzle lines with the drive phases controlled by the phase control section during movement of the recording head unit by the moving unit, an image is recorded with a plurality of pixels reduced by a predetermined reduced pattern, and with predetermined times of repetition of this recording, an image recording in the recording area is completed.

14 Claims, 15 Drawing Sheets

3a
3b
3c
3d
8e
8f
8g
8h
JET ELEMENT
8a
8b
8c
8d
RECORDING HEAD
HEAD DRIVE UNIT
50
IMAGE PROCESSING UNIT
DRIVE SIGNAL GENERATION UNIT
80
7
73
PHASE SETTING UNIT
71
COUNTER UNIT
PHASE MEMORY UNIT
72
74
PIXEL CLOCK GENERATING UNIT
6
RECORDING HEAD CONTROL SECTION
PHASE CONTROL SECTION
70
SPACE MEMORY UNIT

| NOZZLE NO. | PHASE CH | DRIVE PHASE | JETTING POSITION & NOZZLE NO. AT EACH DRIVE PHASE. | | |
|---|---|---|---|---|---|
| | | | 1 | 2 | 3 |
| 1 | A | 1 | ① | | |
| 2 | B | 2 | | ② | |
| 3 | C | 3 | | | ③ |
| 4 | A | 1 | ④ | | |
| 5 | B | 2 | | ⑤ | |
| 6 | C | 3 | | | ⑥ |
| 7 | A | 1 | ⑦ | | |
| 8 | B | 2 | | ⑧ | |
| 9 | C | 3 | | | ⑨ |
| 10 | A | 1 | ⑩ | | |
| 11 | B | 2 | | ⑪ | |
| 12 | C | 3 | | | ⑫ |
| 13 | A | 1 | ⑬ | | |
| 14 | B | 2 | | ⑭ | |
| 15 | C | 3 | | | ⑮ |
| 16 | A | 1 | ⑯ | | |

FIG.9B

| | NOZZLE NO. | PHASE CH | DRIVE PHASE | JETTING POSITION & NOZZLE NO. AT EACH DRIVE PHASE. | | |
|---|---|---|---|---|---|---|
| | | | | 1 | 2 | 3 |
| FIRST HEAD | 1 | A | 1 | 1-① | | |
| | 2 | B | 2 | | 1-② | |
| | 3 | C | 3 | | | 1-③ |
| | 4 | A | 1 | 1-④ | | |
| | 5 | B | 2 | | 1-⑤ | |
| | 6 | C | 3 | | | 1-⑥ |
| | 7 | A | 1 | 1-⑦ | | |
| | 8 | B | 2 | | 1-⑧ | |
| | 9 | C | 3 | | | 1-⑨ |
| | 10 | A | 1 | 1-⑩ | | |
| | 11 | B | 2 | | 1-⑪ | |
| | 12 | C | 3 | | | 1-⑫ |
| | 13 | A | 1 | 1-⑬ | | |
| | 14 | B | 2 | | 1-⑭ | |
| | 15 | C | 3 | | | 1-⑮ |
| | 16 | A | 1 | 1-⑯ | | |
| SECOND HEAD | 1 | A | 1 | | 2-① | |
| | 2 | B | 2 | | | 2-② |
| | 3 | C | 3 | 2-③ | | |
| | 4 | A | 1 | | 2-④ | |
| | 5 | B | 2 | | | 2-⑤ |
| | 6 | C | 3 | 2-⑥ | | |
| | 7 | A | 1 | | 2-⑦ | |
| | 8 | B | 2 | | | 2-⑧ |
| | 9 | C | 3 | 2-⑨ | | |
| | 10 | A | 1 | | 2-⑩ | |
| | 11 | B | 2 | | | 2-⑪ |
| | 12 | C | 3 | 2-⑫ | | |
| | 13 | A | 1 | | 2-⑬ | |
| | 14 | B | 2 | | | 2-⑭ |
| | 15 | C | 3 | 2-⑮ | | |
| | 16 | A | 1 | | 2-⑯ | |

| NOZZLE NO. | PHASE CH | DRIVE PHASE | JETTING POSITION & NOZZLE NO. AT EACH DRIVE PHASE. | | |
|---|---|---|---|---|---|
| | | | 1 | 2 | 3 |
| L-1 | L-A | 1 | L-① | | |
| R-8 | R-B | 2 | | R-② | |
| L-2 | L-C | 3 | | | L-③ |
| R-7 | R-A | 1 | R-④ | | |
| L-3 | L-B | 2 | | L-⑤ | |
| R-6 | R-C | 3 | | | R-⑥ |
| L-4 | L-A | 1 | L-⑦ | | |
| R-5 | R-B | 2 | | R-⑧ | |
| L-5 | L-C | 3 | | | L-⑨ |
| R-4 | R-A | 1 | R-⑩ | | |
| L-6 | L-B | 2 | | L-⑪ | |
| R-3 | R-C | 3 | | | R-⑫ |
| L-7 | L-A | 1 | L-⑬ | | |
| R-2 | R-B | 2 | | R-⑭ | |
| L-8 | L-C | 3 | | | L-⑮ |
| R-1 | R-A | 1 | R-⑯ | | |

FIRE
STB1
STB2
STB3
30a
30b
30c
p

FIRE
STB1
STB2
STB3
30a
30b
30c

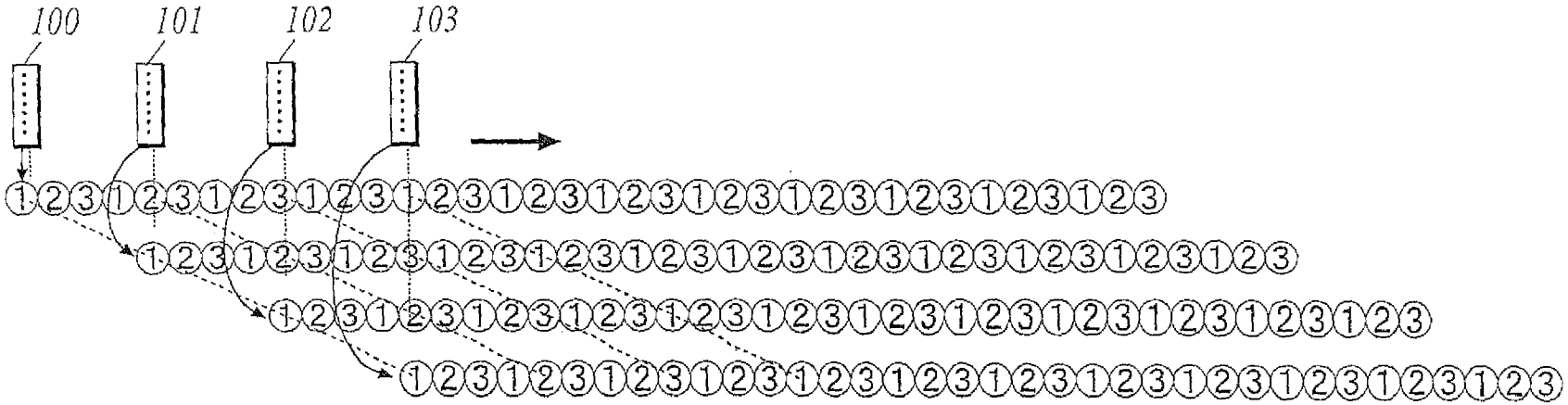
FIG.14A PRIOR ART
FIG.14B PRIOR ART
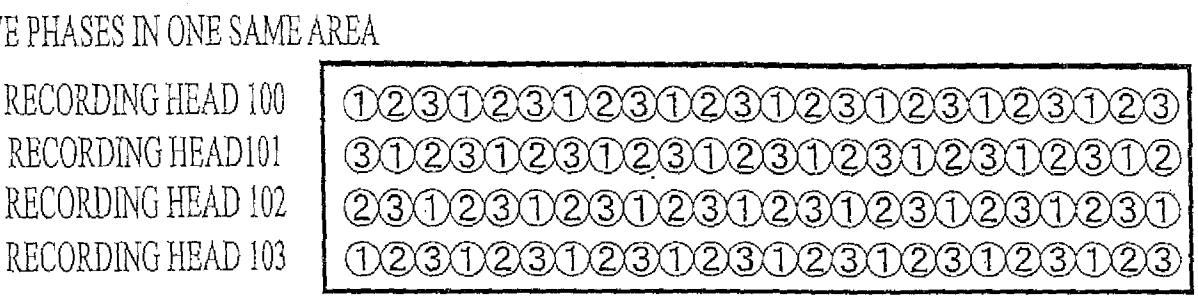

PHASE CONTROLLED, MULTI-PASS INKJET RECORDING APPARATUS AND METHOD

BACKGROUND OF THE INVENTION

1. Field of the Invention

The present invention relates to an inkjet recording apparatus and an inkjet recording method, to record images on a recording medium by jetting inks.

2. Description of Related Art

There has been known an inkjet recording apparatus which records images by jetting inks from nozzles on recording heads, as a recording apparatus printable on a recording medium, such as plain paper or the like.

Recently, in an inkjet recording apparatus, while it has been made efforts to achieve higher quality of images by making the density of nozzles on a recording head higher, the load of drive circuits for recording heads has been reduced by driving nozzles in each nozzle line on the recording head at different timings to reduce the number of synchronized nozzles.

As an inkjet recording apparatus in which nozzles in a nozzle line are driven at different timings, there have been known an inkjet recording apparatus in which the so-called staggered arrangement of nozzles are driven with a plurality of drive phases (refer to, for examples, JP-Tokukai-2002-137388A, JP-Tokukai-2003-326687A and JP-Tokukai-sho-59-33117A), and an inkjet recording apparatus that employs the so-called multi-pass recording system (refer to, for example, Japanese Patent 3441868). Here, the staggered arrangement is an arrangement that, in a nozzle line having a plurality of nozzles arranged in the conveying direction of a recording medium, nozzle positions are displaced in a scanning direction for every drive phase. The multi-pass recording is a recording system that a serial type recording head scans one same area on a recording medium by plural times to complete an image recording on the area.

In the recording head of the inkjet recording apparatus having staggered arrangement of nozzles, for instance, the nozzles are driven with 3-phase drive in order of phase 1, phase 2 and phase 3 for every 3 nozzles arranged in the conveying direction. That is, as shown in FIG. 13A, nozzles 30*a*, 30*b* and 30*c* corresponding to phase 1, phase 2 and phase 3, respectively, are so controlled that their phases are switched by respective strobe pulses STB 1 to STB 3. In this inkjet recording apparatus, the nozzle position displacement can be compensated by 3 phase switchings while the recording head moves by one pixel, and thus dots can be recorded in a straight line. In FIG. 13A, the strobe pulse STB 1 switches the phase of the nozzle 30*a*, STB 2 the nozzle 30*b*, and STB 3 the nozzle 30*c*.

With use of a serial type recording head in which the above-described recording head is mounted on a carriage, each phase has to be switched while the recording head moves by one pixel for recording dots in a straight line, so that scanning speed of the carriage is limited by the number of drive phases for nozzles on the recording head. That is, the increased number of drive phases requires the increased number of switching of strobe pulses, which causes a strobe pulse width to be relatively narrower and the carriage speed to be reduced at the rate.

The scanning speed of the carriage is also limited by a staggered pitch p between nozzles. That is, because one pixel has to be recorded in a time t1 during which a nozzle moves by the staggered pitch p, a time t2 necessary for jetting ink for one pixel is not more than the time t1 (=staggered pitch p/scanning speed V), as shown in the following expression (1). Therefore, the upper limit of the scanning speed V is, as shown in the following expression (2), a value of the staggered pitch p divided by the time t2 necessary for jetting ink for one pixel. From this relationship, in order to get higher scanning speed, it may be a solution to make the staggered-pitch larger, but larger staggered pitch makes the size of the recording head larger, and requires new development of manufacturing technology.

$$t2 \leqq t1\ (=p/V) \tag{1}$$

$$V \leqq p/t2 \tag{2}$$

As described above, an inkjet recording apparatus having staggered nozzles with multi-phase drive is limited in the scanning speed and cannot record images at higher speed.

On the other hand, as a recording head in an inkjet recording apparatus using the multi-pass recording system, there may be used such a head that adopts the so-called multi-phase drive method, for example, the same 3-phase drive as that of the head described above, in which, as shown in FIG. 13B, drive phases of nozzles 30*a*, 30*b* and 30*c*, corresponding to phase 1, phase 2 and phase 3 are controlled so as to be switched by strobe pulses STB 1 to STB 3, respectively. In this type of inkjet recording apparatus, pixels on one same line, which should originally be recorded by one same nozzle, are divided into plural sections and each section is recorded by mutually different nozzles. With this method, even if there is found misalignment of nozzles or ink jetting failure in some nozzles, these irregularities could be made averaged and could be perceived as unnoticeable dot displacement and the like. This type of inkjet recording apparatus is different from the inkjet recording apparatus having staggered nozzles, and can achieve higher image recording speed to the extent that the scanning' speed is not limited by the number of nozzle-drive phases and the staggered pitch.

In the inkjet recording apparatus using the multi-pass recording system as described above, let it be assumed that a plurality of nozzle lines are arranged on a carriage in a scanning direction, such as in the case as shown in FIGS. 14A and 14B, for example, that 4 recording heads are mounted on the carriage for jetting Y, M, C and K color inks, and that the number of pixels corresponding to the distance between nozzle lines is not equal to a multiple of the number of drive phases. With this structure, if nozzle lines are driven by the same phase at their drive timings, the relationship between the positions of a nozzle line in the scanning direction and the phases of the nozzle line differs from each other among the nozzle lines. Accordingly, relative positional relationship among the dots formed by the nozzle lines cannot be represented correctly, so that image quality of thin lines or characters is sometimes reduced.

SUMMARY OF THE INVENTION

An object of the invention is to provide an inkjet recording apparatus and an inkjet recording system capable of recording images with higher quality at higher speed compared with conventional ones.

In order to achieve the object, the inkjet recording apparatus according to the first aspect of the invention, the inkjet recording apparatus comprises:

at least one recording head unit having a plurality of nozzle lines driven with multi-phase drive;

a moving unit to move the recording head unit by predetermined times in a scanning direction crossing the nozzle lines in an area facing one same recording area on a recording medium;

a clock generating unit to generate clock signals every time the recording head unit moves by a predetermined distance with the moving unit; and a recording head control section to control the recording head unit and to include a phase control section to control each drive phase of the plurality of nozzle lines on the basis of the clock signals, wherein the recording head control section controls the recording head unit such that, by driving the nozzle lines with the drive phases controlled by the phase control section during movement of the recording head unit by the moving unit, an image is recorded with a plurality of pixels reduced by a predetermined reduced pattern, and with predetermined times of repetition of this recording, an image recording in the recording area is completed.

According to the first aspect of the invention, since the phase control section controls drive phases of the plural nozzles, the relationship between the positions of a nozzle line in the scanning direction and the drive phases of the nozzle line can be matched each other among the nozzle lines, so that relative positional relationship of dots formed by the nozzle lines can be correctly represented in the scanning direction. Therefore, image quality can be improved compared with the prior technique.

Further, the multi-pass recording system with a multi-phase drive method can reduce the load of drive circuits for the recording head unit. Additionally, being different from prior apparatus having staggered nozzles, the image recording speed can be improved to the extent that the scanning speed is not limited by the number of drive phases and the staggered pitch of nozzles.

As a result, images can be recorded with higher quality at higher speed than prior ones.

Here, the multi-phase drive of a nozzle line means a drive to be controlled on the basis of every nozzle group wherein nozzles in the nozzle line form a plurality of nozzle groups.

The recording head unit includes at least one recording head for jetting ink. In case that the recording head unit includes a plurality of recording heads, these recording heads may jet ink of one same color, or jet inks of different colors.

The inkjet recording apparatus according to the first aspect of the invention may have a recording head unit or may have a plurality of recording head units. In case that the inkjet recording apparatus has a recording head unit, a plurality of nozzle lines may jet ink of one same color, or jet inks of different colors.

In case that the inkjet recording apparatus has a plurality of recording head units, a plurality of nozzle lines of each recording head unit may jet ink of one same color, or jet inks of different colors. In case that the inkjet recording apparatus has a plurality of recording head units, each of recording head units may jet ink of one same color, or jet inks of different colors. Further, in case that the inkjet recording apparatus has a plurality of recording head units, the recording head control section to control the recording head unit may be provided for each of the plurality of recording head units or one recording head control section may be provided for controlling all of the plurality of recording head units.

The predetermined distance may be of one pixel or plural numbers of pixels, or may be that less than one pixel.

Preferably, the phase control section comprises: space memory units to store spaces of the plurality of nozzle lines; and a timing adjusting unit to adjust ink-jet timing among the plurality of nozzle lines on the basis of the clock signals and the spaces.

According to this structure, the space memory units store the spaces of plurality of nozzle lines, and the timing adjusting units adjust ink-jet timings of respective nozzles on the basis of the clock signals and the spaces, so that positional deviation of dots caused by the displacement of nozzle-line positions in the scanning direction can be compensated. Accordingly, relative positional relationship of dots formed by the nozzle lines can be more correctly represented in the scanning direction, to thereby surely improve image quality.

Here, each memory unit may preferably store, as a space between nozzle lines, the difference of the numbers of clock signals counted from the start of movement of the recording head unit to the arrival at a predetermined position of the nozzle line.

Preferably, the phase control section comprises phase setting units to switch the drive phases of the plurality of nozzle lines in predetermined phase orders on the basis of the clock signals.

According to such a structure, since the phase setting units switch the drive phases of the plurality of nozzle lines in respective predetermined phase orders, the relationship between the positions of a nozzle line in the scanning direction and the drive phases of the nozzle line can be correctly matched each other among the nozzle lines. Accordingly, relative positional relationship of dots formed by the nozzle lines can be more correctly represented in the scanning direction, thereby more surely improving image quality.

Preferably, the phase control section comprises starting phase memory units to store starting drive phases specific to respective nozzle lines as starting drive phases of the plurality of nozzle lines, and the phase setting units set respective starting drive phase stored in the starting phase memory units as the starting drive phases of respective nozzle lines.

Here, the starting drive phase is a drive phase prior to switching by the phase setting unit, for example, the drive phase set to each nozzle line when the recording head unit starts moving.

According to such a structure, since the phase setting units set the starting drive phases specific to respective nozzle lines, the relationship between the positions of a nozzle line in the scanning direction and the drive phases of the nozzle line can be more correctly matched each other among the nozzle lines.

Preferably, the phase control section comprises phase order memory units to store phase orders specific to respective nozzle lines as the predetermined phase orders, and the phase setting units switch the drive phases of respective nozzle lines on the basis of the predetermined phase orders stored in the phase order memory units.

With such a structure, the phase setting units switch the drive phases of respective nozzle lines on the basis of the phase orders specific to respective nozzle lines, so that the relationship between the positions of a nozzle line in the scanning direction and the drive phases of the nozzle line can be more correctly matched each other among the nozzle lines.

Preferably, the inkjet recording apparatus further comprises an irradiating device to irradiate light toward an ink deposited on the recording medium, wherein the recording head unit jets photo-curable ink.

Preferably, the irradiating device irradiates ultraviolet rays, and the recording head unit jets ultraviolet curable ink.

Preferably, the ink is cationic polymerization type ink.

The ink used which is of cationic polymerization type is less affected by oxygen in the polymerization reaction than the radical polymerization type or the hybrid type. Further, the ink is curable with long-time irradiation even under low-intensity ultraviolet rays because it is of energy accumulating type, being different from the radical polymerization type or the hybrid type.

In accordance with a second aspect of the invention, the inkjet recording method comprises:

moving at least one recording head unit having a plurality of nozzle lines driven with multi-phase drive, by predetermined times in a scanning direction crossing the nozzle lines in an area facing one same recording area on a recording medium;

generating clock signals every time the recording head unit moves by a predetermined distance with the moving unit; and controlling the recording head unit, which includes controlling each drive phase of the plurality of nozzle lines on the basis of the clock signals, wherein in the controlling the recording head unit, by driving the nozzle lines with the drive phases controlled by the phase control section during movement of the recording head unit by the moving unit, an image is recorded with a plurality of pixels reduced by a predetermined reduced pattern, and with predetermined times of repetition of this recording, an image recording in the recording area is completed.

According to such an inkjet recording method, the phase controller controls each drive phase of the plurality of nozzle lines, whereby the relationship between the positions of a nozzle line in the scanning direction and the drive phases of the nozzle line can be matched to each other among the nozzle lines. Accordingly, relative positional relationship of dots formed by the nozzle lines can be correctly represented in the scanning direction, so that image quality can be improved compared with the prior one.

Further, by performing the multi-pass recording with a multi-phase drive method, the load of drive circuits for the recording head unit can be reduced. Additionally, being different from prior apparatus having staggered nozzles, the image recording speed can be improved to the extent that the scanning speed is not limited by the number of drive phases and the staggered pitch of nozzles.

As a result, images can be recorded with higher quality at higher speed than prior ones Preferably, the controlling each drive phase of the plurality of nozzle lines comprises adjusting ink-jet timing among the plurality of nozzle lines on the basis of spaces of the plurality of nozzle lines and the clock signals.

According to such a method, because the ink-jet timing among the plurality of nozzles are adjusted on the basis of spaces of the plurality of nozzle lines and the clock signals, positional deviation of dots caused by the displacement of nozzle-line positions in the scanning direction can be compensated. Accordingly, relative positional relationship of dots formed by the nozzle lines can be more correctly represented in the scanning direction, to thereby improve image quality with reliability.

In the inkjet recording method according to the second aspect of the invention, preferably, the controlling each drive phase of the plurality of nozzle lines comprises adjusting ink-jet timing among the plurality of nozzle lines on the basis of spaces of the plurality of nozzle lines and the clock signals.

According to such a method, the phase setting switches the drive phases of the plurality of nozzle lines in respective predetermined phase orders, so that the relationship between the positions of a nozzle line in the scanning direction and the drive phases of the nozzle line can be correctly matched each other among the nozzle lines. Accordingly, relative positional relationship of dots formed by the nozzle lines can be more correctly represented in the scanning direction, thereby more surely improving image quality.

In the inkjet recording method, preferably, starting drive phases specific to the plurality of nozzle lines are used as starting drive phases of the plurality of nozzle lines.

According to such a method, in the phase setting, starting drive phases specific to respective nozzle lines are used as the starting drive phases of the plurality of nozzle lines, so that the relationship between the positions of a nozzle line in the scanning direction and the drive phases of the nozzle line can be more correctly matched each other among the nozzle lines.

In the inkjet recording method, preferably, as the predetermined phase orders, phase orders specific to respective nozzle lines are used.

According to such a method, by using the phase orders specific to respective nozzle lines as the predetermined phase orders, the relationship between the positions of a nozzle line in the scanning direction and the drive phases of the nozzle line can be more correctly matched each other among the nozzle lines.

Preferably, the inkjet recording method further comprises irradiating light toward inks deposited on the recording medium, and the recording head unit jets photo-curable ink.

Preferably, in the inkjet recording method, the recording head unit jets ultraviolet curable ink and ultraviolet rays are used as the light.

In the inkjet recording method, preferably, a cationic polymerization type ink is used as the ink.

In such an inkjet recording method, by employing cationic polymerization type ink, the ink is less affected by oxygen in the polymerization reaction than the radical polymerization type or hybrid type of ink, and is curable with long-time irradiation even under low-intensity ultraviolet rays because it is of energy accumulating type, being different from the radical polymerization type or the hybrid type.

BRIEF DESCRIPTION OF THE DRAWINGS

The present invention will become more fully understood from the detailed description given hereinbelow and the accompanying drawings which are given by way of illustration only, and thus are not intended as a definition of the limits of the invention, and wherein;

FIG. 9B is a diagram showing the relationship between nozzle numbers and drive phases;

FIG. 14A illustrates drive phases for each nozzle line, and FIG. 14B illustrates the drive phases for nozzle lines in one same recording area.

DETAILED DESCRIPTION OF THE PREFERRED EMBODIMENTS

Hereinafter, preferred embodiments of the present invention will be described with reference to the drawings.

First Embodiment

Figure 1:
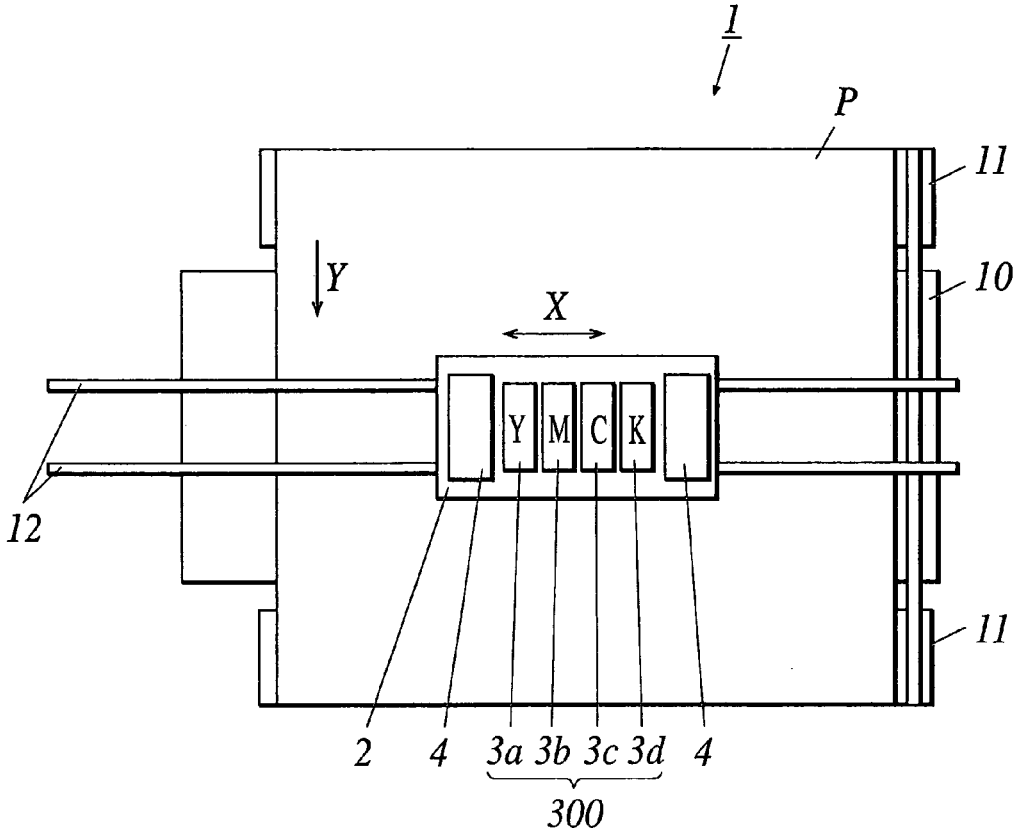
FIG. 1 is a schematic plan view showing the structure of an inkjet recording apparatus according to the invention.

FIG. 1 is a schematic plan view showing the structure of an inkjet recording apparatus 1 according to the invention.

As shown in this figure, the inkjet recording apparatus 1 has a platen 10 for supporting a recording medium P thereon. The platen 10 has an approximately flat surface by which the recording medium P is supported from the back side.

At the upper side and the lower side relative to the platen 10 in this figure, there are disposed conveying devices 11 including rollers and the like for conveying the recording medium P in a conveying direction Y. Above the platen 10, there are also disposed a pair of guide rails 12 extending in a direction perpendicular to the conveying direction Y (hereinafter, referred to as "scanning direction X"), and supporting a carriage 2. The carriage 2 functions as a moving unit and is movable back and forth in the scanning direction X above the recording medium P with guided by the guide rails 12. When the recording apparatus 1 records images, the carriage 2 moves from a record starting position at a side (not shown) outside the recording medium P to a position above the medium P.

Figure 2:
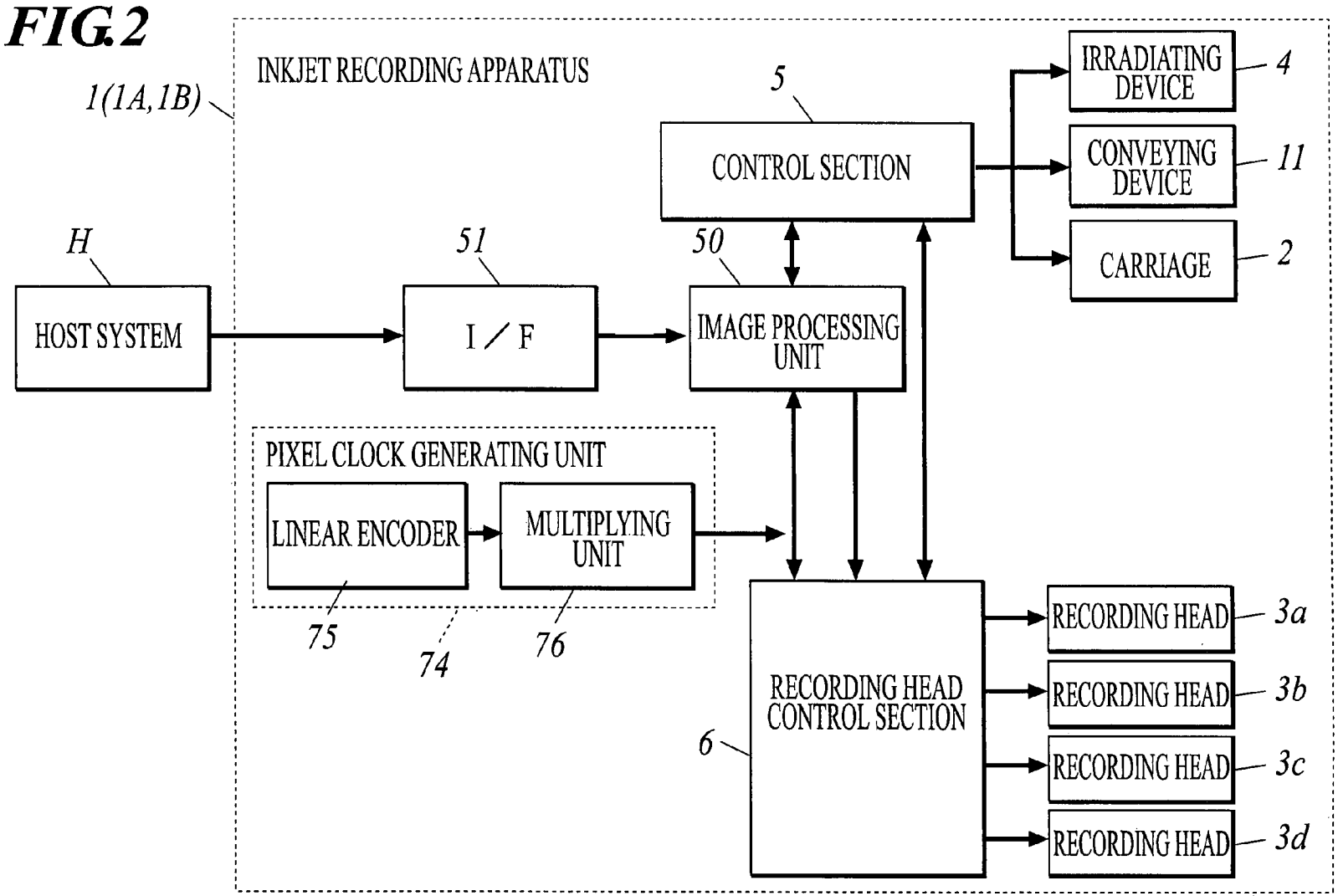
FIG. 2 is a schematic block diagram showing the structure of the inkjet recording apparatus according to the present invention.

The carriage 2 has a pixel clock generating unit 74 (see FIG. 2) for generating a clock signals according to the moving amount of the carriage 2. The pixel clock generating unit 74 includes, as shown in FIG. 2, a linear encoder 75 and a multiplying unit 76. The linear encoder 75 generates an electric signal every time the carriage 2 moves by a predetermined distance, or 4-pixel distance in the embodiment. The multiplying unit 76 produces clock signals by multiplying the electric signal generated by the linear encoder 75 by an integer times (4 times in the embodiment). The clock signals produced by the multiplying unit 76 is input to an image processing unit 50 which will be described later, and a recording head control section 6.

The carriage 2 also has a recording head unit 300 mounted thereon, as shown in FIG. 1.

The recording head unit 300 includes four recording heads 3*a*-3*d*. These recording heads 3*a*-3*d* jet inks of yellow (Y), magenta (M), cyan (C) and black (B), respectively, and arranged in this order in the scanning direction X.

Figure 3:
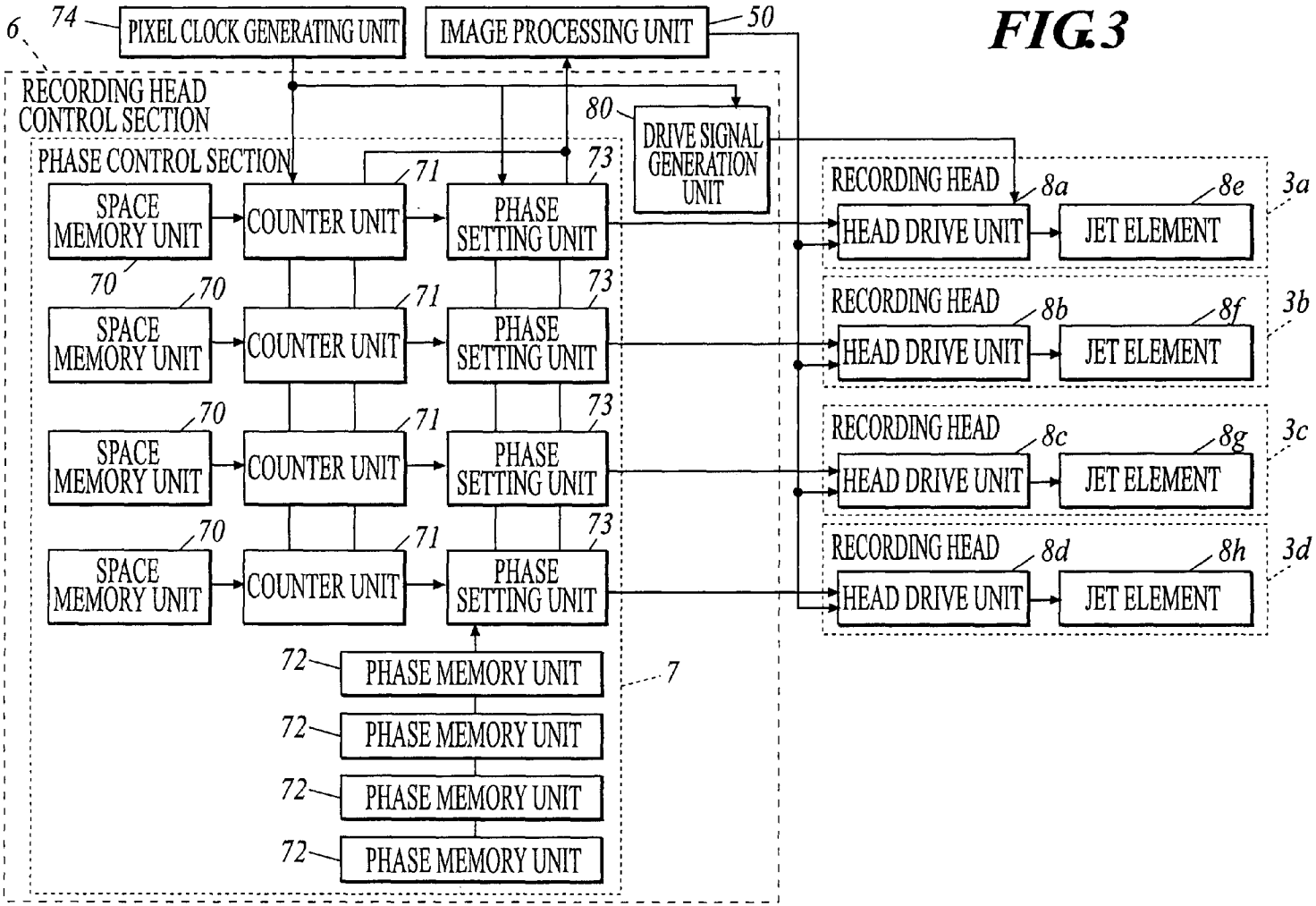
FIG. 3 is a schematic block diagram for explaining the structure of a recording head control unit.

The recording heads 3*a*-3*d* have, as shown in FIG. 3, head drive units 8*a*-8*d*, and jet elements 8*e*-8*h*, respectively.

The head drive units 8*a*-8*d* drive the jet elements 8*e*-8*h*, respectively, on the basis of signals input from the image processing unit 50, phase setting units 73 and a drive signal generation unit 80, which will be described later.

The jet elements 8*e* to 8*h* are the so-called piezoelectric elements, for driving to jet inks through nozzles 30, . . . (see FIG. 4A).

Figures 4A, 4B:
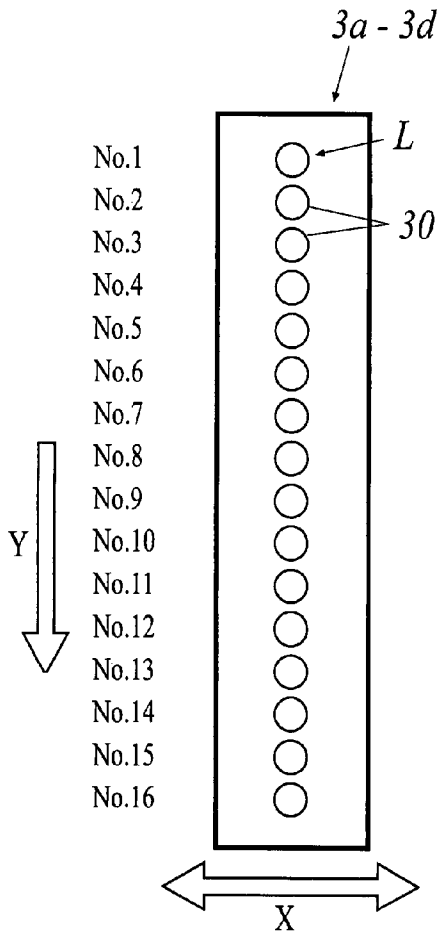
FIG. 4A is a bottom view of a recording head.
FIG. 4B is a diagram showing the relationship between nozzle numbers and drive phases.

As shown in FIG. 4A, these nozzles 30, . . . of each of the heads 3*a*-3*d* are aligned in the conveying direction Y on a surface facing the recording medium P, that is, on the back surface, forming a nozzle line L for multi-phase drive. In the embodiment, each of the heads 3*a*-3*d* has 16 nozzles 30, as an example, and the space between adjacent nozzle lines L and L is set to 4-pixel width (see FIG. 5A).

The nozzles 30, . . . in each nozzle line L have nozzle numbers allotted thereto from No. 1 in due order from the upstream side to the downstream side in the conveying direction Y, and phase channels are set thereto on the basis of these nozzle numbers.

Specifically, in the embodiment, 3 phases of channels are set to the nozzles 30 . . . in the nozzle line L. As shown in FIG. 4B, a phase channel "A" is set to nozzles 30 . . . having nozzle numbers 3*n*-2 (n are integers not less than 1) (hereinafter, nozzle 30A), a phase channel "B" is set to nozzles 3*n*-1 (hereinafter, nozzle 30B), and a phase channel "c" is set to nozzles 3*n* (hereinafter, nozzle 30C).

Each of the inks jetted from the recording heads 3*a*-3*d* is an ultraviolet curable ink. The ultraviolet curable ink includes radical polymerization type ink, cationic polymerization type ink, and hybrid type ink that is a mixture of both types of inks. In the embodiment, a cationic polymerization type ink is used. The cationic polymerization type ink has advantages that it is less affected by oxygen in the polymerization reaction in comparison with the radical polymerization type ink or the hybrid type ink, and that it is curable with long-time irradiation even under low-intensity ultraviolet rays because it is of energy accumulating type, being different from the radical polymerization type or the hybrid type.

The carriage 2 has, as shown in FIG. 1, irradiating devices 4 and 4 for irradiating ultraviolet rays toward the underlying recording medium P.

The irradiating devices 4 and 4 are disposed in right and left both sides of the recording heads 3*a*-3*d* in the figure. Each irradiating device 4 has an LED (light emitting diode) or an LD (semiconductor laser) as a light source of ultraviolet rays.

The irradiating devices 4 and 4, the above-described transport devices 11 and the carriage 2 are connected to a control section 5, as shown in FIG. 2.

The control section 5 includes a CPU, a ROM and a RAM and the like, to drive and control each unit of the inkjet recording apparatus 1. Specifically, the control section 5, for instance, controls the irradiating device 4 to cure inks on the surface of the medium P by irradiation of ultraviolet rays. The control section 5 also controls the conveying device 11 to intermittently transport the recording medium P. Further, the control section 5 controls the carriage 2 to move the recording heads 3*a*-3*d* and the irradiating devices 4 and 4 in the scanning direction X.

The control section 5 is connected to the image processing unit 50 and the recording head control section 6.

The image processing unit 50 decodes image data input from a host system H via an interface (I/F) 51. The image data decoded by the image processing unit 50 are input to the control section 5 and the recording head control section 6, by being synchronized with the clock signals output from the pixel clock generating unit 74. Here, the host system H is connected to external devices (not shown) through a network. These host system H and external devices send the image data and various instruction signals to the inkjet recording apparatus 1. In these host system H and external devices, it is also possible to set a drive frequency for driving the recording head 3*a* to 3*d*.

The recording head control section 6 controls each of the recording heads 3*a* to 3*d*, and has, as shown in FIG. 3, a phase control section 7 and a drive signal generation unit 80.

The phase control section 7 includes four space memory units 70, . . . , four counter units 71, . . . , four phase memory units, 72 . . . , and four phase setting units 73, . . . .

The space memory units 70 store respective spaces between nozzle lines L and L of the recording heads 3*a* to 3*d*. Each space memory unit 70 in the embodiment stores, as the space between nozzle lines L and L, a difference of the number of clock signals counted from a start timing to an arrival timing, the start timing being the time when the carriage 2 at the record starting position, e.g., a predetermined position outside the region of recording medium P, starts moving, and the arrival timing being the time when each nozzle line L reaches a position above the edge of the recording medium P.

Figure 5A:
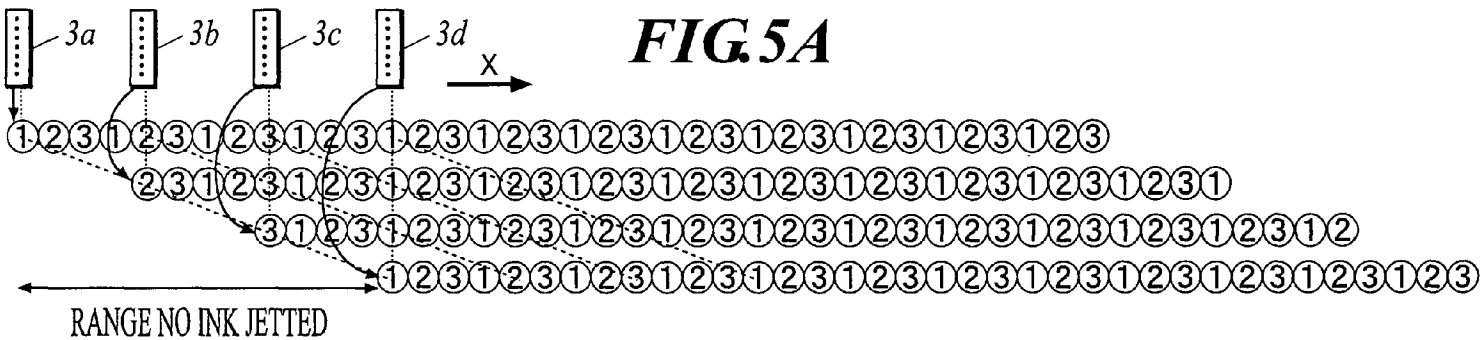
FIG. 5A illustrates drive phases for each nozzle line.

In more detail, the space memory unit 70 for the recording head 3*a* stores the difference of the numbers of clock signals for the heads 3*d* and 3*a*, counted until the respective nozzle lines L and L for the heads 3*d* and 3*a* reach the position above the left side edge of the recording medium P in FIG. 1, when the carriage 2 moves from the record starting position in the left side outside the recording medium P in FIG. 1 toward the right side with respect to the medium P. The difference of the number of clock signals in the embodiment is twelve, as shown in FIG. 5A.

The space memory unit 70 for the recording head 3*b* also stores the difference of the numbers of clock signals counted until the respective nozzle lines L and L for the heads 3*d* and 3*b* reach the left side edge of the recording medium P in FIG. 1, when the carriage 2 moves from the record starting position in the left side in FIG. 1 toward the right side with respect to the recording medium P. The difference of the numbers of clock signals in the embodiment is eight, as shown in FIG. 5A.

The space memory unit 70 also stores the difference of the numbers of clock signals counted until the respective nozzle lines L and L for the heads 3*a* and 3*b* reach the right side edge of the recording medium P in FIG. 1, when the carriage 2 moves from the record starting position in the right side in FIG. 1 toward the left side with respect to the recording medium P. The difference of the numbers of clock signals in the embodiment is four, as shown in FIG. 5A.

The space memory unit 70 for the recording head 3*c* also stores the difference of the numbers of clock signals counted until the respective nozzle lines L and L for the heads 3*d* and 3*c* reach the left side edge of the recording medium P in FIG. 1, when the carriage 2 moves from the record starting position at the left side in FIG. 1 toward the right side with respect to the recording medium P. The difference of the numbers of clock signals in the embodiment is four, as shown in FIG. 5A.

The space memory unit 70 also stores the difference of the numbers of clock signals counted until the respective nozzle lines L and L for the heads 3*a* and 3*c* reach the right side edge of the recording medium P in FIG. 1, when the carriage 2 moves from the record starting position in the right side in FIG. 1 toward the left side with respect to the recording medium P. The difference of the numbers of clock signals in the embodiment is eight, as shown in FIG. 5A.

The space memory unit 70 for the recording head 3*d* also stores the difference of the numbers of clock signals counted until the respective nozzle lines L and L for the heads 3*a* and 3*d* reach the right side edge of the recording medium P in FIG. 1, when the carriage 2 moves from the record starting position in the right side in FIG. 1 toward the left side relatively to the recording medium P. The difference of the number of clock signals in the embodiment is twelve, as shown in FIG. 5A.

The counter units 71 function as timing adjusting units. Specifically, the counter units 71 count the clock signals input from the pixel clock generating unit 74, and adjust respective ink jet timings among the plural nozzle lines L, . . . on the basis of the respective spaces of nozzle lines L, . . . input from the space memory units 70.

The phase memory units 72 function as starting phase memory units and phase order memory units, and store starting drive phases and phase orders specific to the respective nozzle lines L, . . . . In the embodiment, as shown in FIG. 5A, the starting drive phase for the nozzle line L of the recording head 3*a* is "1", and the phase order is in order of "1", "2" and "3"; for the head 3*b*, the starting drive phase is "2" and the phase order is "2", "3" and "1"; for the head 3*c*, the starting drive phase is "3", and the phase order is "3", "1" and "2"; and for the head 3*d*, the starting drive phase is "1", and the phase order is "1", "2" and "3".

The phase setting unit 73 sets drive phases to nozzle groups of respective phase channels in the nozzle line L. In the embodiment, as shown in FIG. 4B, the relationship between the phase channels and the drive phases is set such that a nozzle group of phase channel "A" is driven by drive phase "1", a nozzle group of "B" is driven by drive phase "2" and a nozzle group of "C" is driven by drive phase "3".

The phase setting units 73 also set starting drive phases of the head drive units 8*a*-8*d* corresponding to the respective nozzle lines L, . . . by sending strobe pulses (refer to FIG. 13B) corresponding to respective starting drive phases stored in the phase memory units 72. Timings for the strobe pulses to be sent are synchronized with the jet timings adjusted by the counter units 71.

Further, the phase setting units 73 switch drive phases of the head drive units 8*a*-8*d* corresponding to the respective nozzle lines L, . . . by sending strobe pulses to the head drive units 8*a*-8*d* on the basis of the respective phase orders stored in the phase memory units 72. Timings for the strobe pulses to be sent are synchronized with the clock signals sent from the pixel clock generating unit 74.

Here, the starting drive phases mean in the embodiment the drive phases set to respective nozzle lines L, . . . at the time the carriage 2 starts moving.

The drive signal generation unit 80 generates pulse signals on the basis of the clock signals input from the pixel clock generating unit 74. The pulse signals generated by the drive signal generation unit 80 are input to each of the head drive units 8*a*-8*d*.

Next, an inkjet recording method according to the invention will be described with reference to FIG. 6A. It is assumed in the following description that the so-called allover image is recorded by forming dots on allover pixels on the recording medium P.

First, when the host system H or the external device inputs image data to the control section 5 via the I/F 51 and the image processing unit 50, the control section 5 moves the carriage 2 up to the record starting position of the recording medium P.

Next, under the state that conveyance of the medium P by the conveying device 11 is halted, the carriage 2 performs first scanning in the scanning direction X right over the medium P. This allows the recording heads 3*a*-3*d* and the irradiating devices 4 and 4 to scan following the carriage 2 (step S1, moving step). Thereafter, the pixel clock generating unit 74 generates the clock signals according to the moving amount of the carriage 2 (step S2, clock generating step).

At this time, the phase control section 7 controls the drive phases for respective nozzle lines L, . . . of the recording heads 3*a*-3*d* (step S3, phase control step (recording head control step)).

Figure 6A:
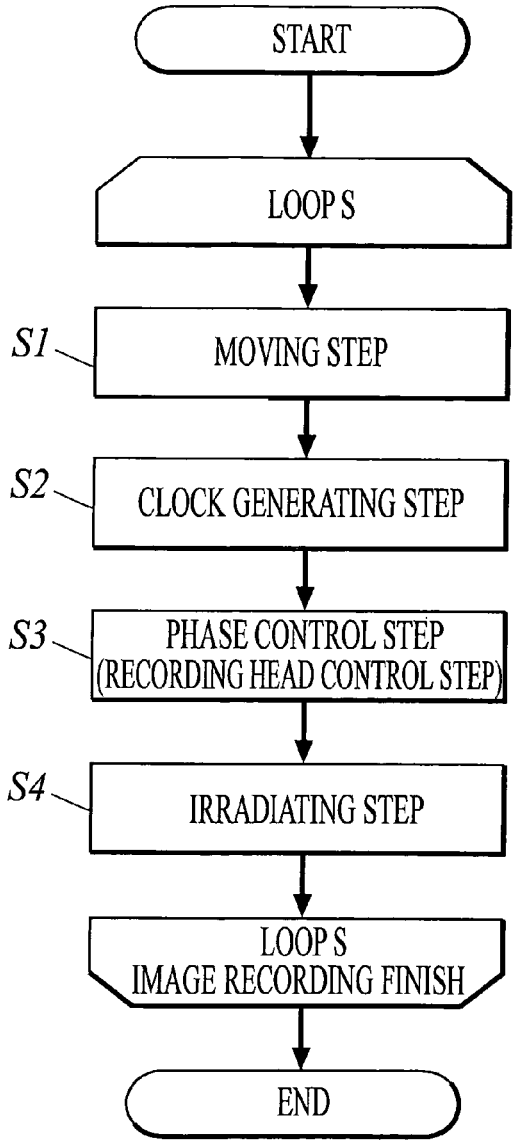
FIG. 6A is a flow chart for explaining the inkjet recording method according to the invention.
Figure 6B:
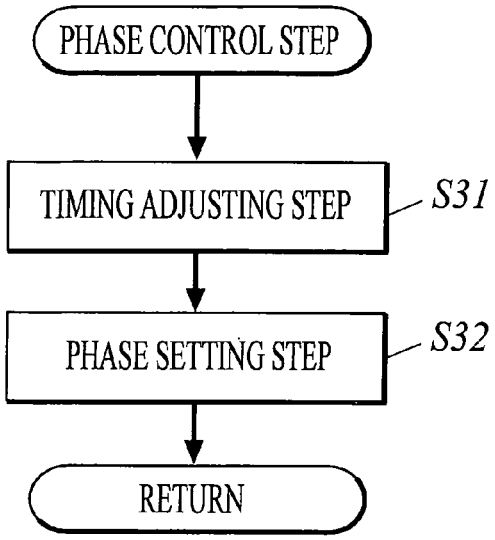
FIG. 6B is a flow chart for explaining the phase control step.

To be concrete, as shown FIG. 6B, on the basis of the clock signals from the pixel clock generating unit 74 and the spaces of nozzle lines L, . . . input from the space memory units 70, the counter units 71, adjust the ink jet timings for the nozzle lines L, of the heads 3*a*-3*d* (step S31, timing adjusting step). That is, when the carriage 2 moves from the left side to the right side in FIG. 1, as shown in FIG. 5A, with respect to the ink jet timing for the nozzle line L of the recording head 3*d*, the ink jet timing for the nozzle line L of the recording head 3*c* causes to be delayed by 4 pixels, for the head 3*b* by 8 pixels, and for the head 3*a* by 12 pixels. When the carriage 2 moves from the right side to the left side in FIG. 1, with respect to the ink jet timing for the nozzle line L of the recording head 3*a*, the ink jet timing for the nozzle line L of the recording head 3*b* causes to be delayed by 4 pixels, for the head 3*c*, causes to be delayed by 8 pixels, and for the head 3*d*, causes to be delayed by 12 pixels.

Thus, by adjusting the ink jet timings of nozzles 30, . . . , on the basis of the clock signals and the spaces between the plural nozzle lines L, . . . , dot position deviation caused by the displacement of nozzle-line positions in the scanning direction X can be compensated. In the embodiment, dot-formed positions match each other among the nozzle lines L, . . . , in the scanning direction X.

The phase setting units 73, . . . , set the starting drive phases to the respective head drive units 8*a*-8*d*, according to the ink jet timings adjusted by the counter units 71 and the clock signals from the pixel clock generating unit 74, and switch the set drive phases (step S32, phase setting step). At this time, the phase setting units 73, . . . use the starting drive phases and the phase orders stored in the phase memory units 72.

Figure 5B:
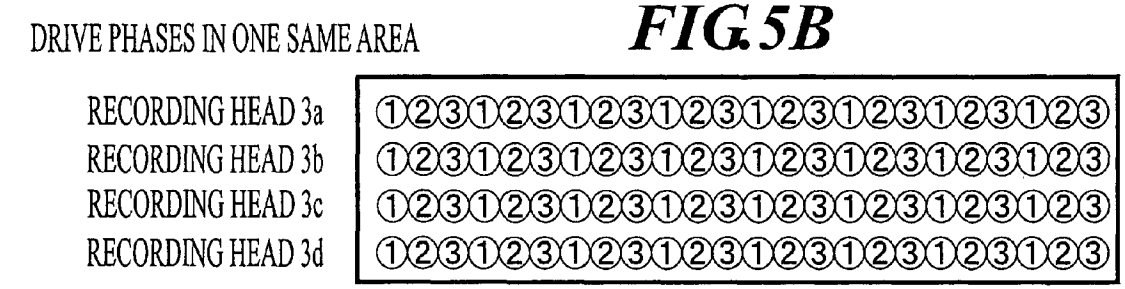
FIG. 5B illustrates the drive phases for nozzle lines in one same recording area.

Thus, the phase control section 7 sets the drive phases of each nozzle line L using the starting drive phases and phase orders specific to respective nozzle lines L . . . , so that, as shown in FIG. 5B, relationship between positions of a nozzle line L in the scanning direction X and drive phases of the nozzle line L is surely suited to each other among the nozzle lines L, . . . , being different from conventional one.

Figure 7:
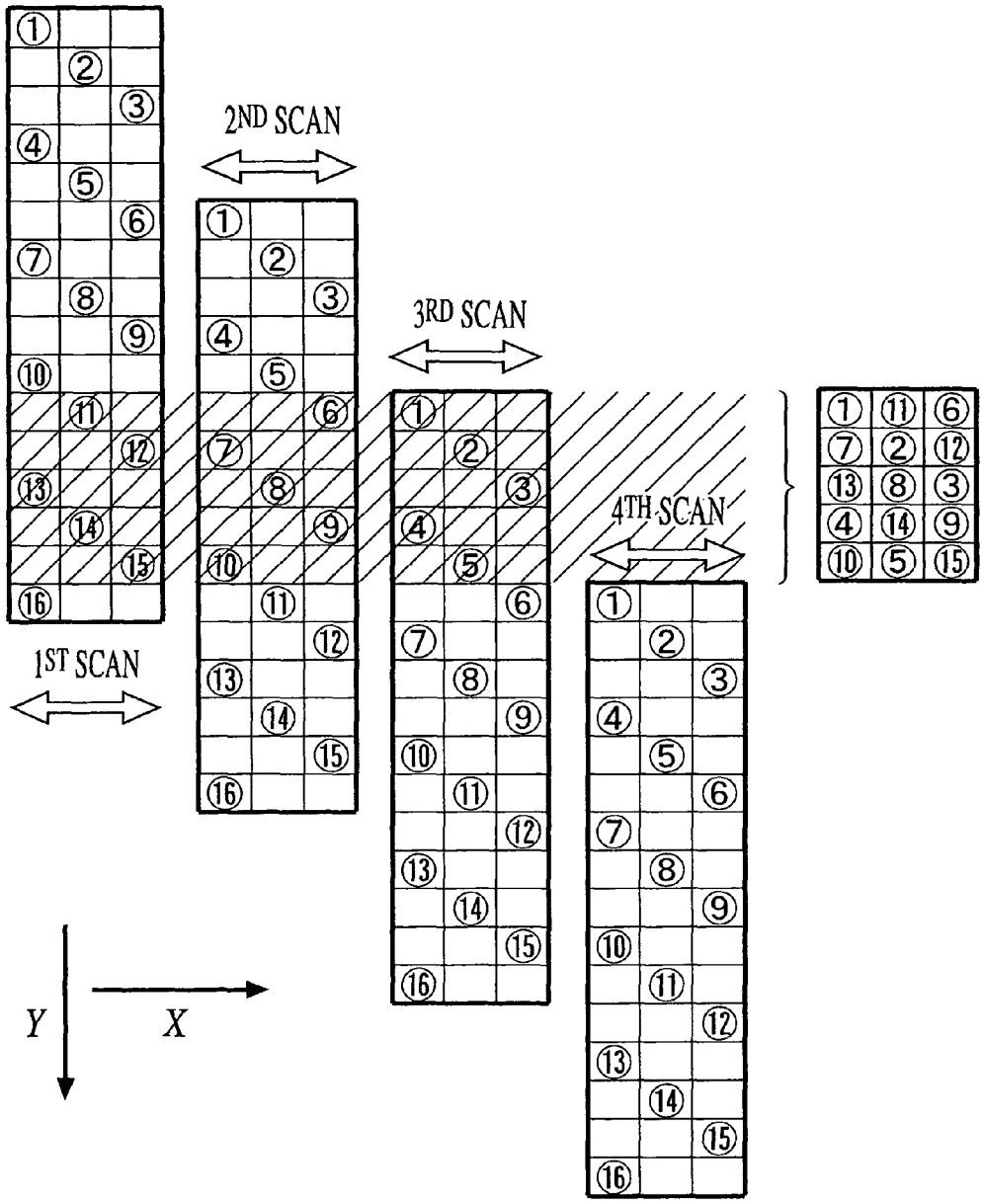
FIG. 7 is a diagram showing a recorded image in case that a multi-pass recording is performed by using the recording head of FIGS. 4A and 4B.
Figure 13A:
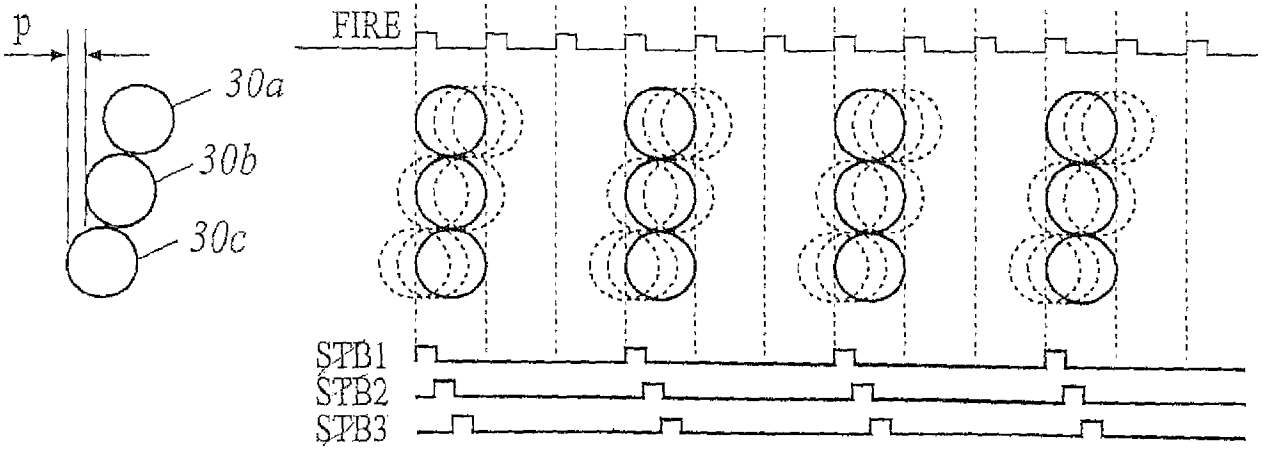
FIG 13A PRIOR ART
FIG. 13A illustrates drive phases in case that dots are recorded in a straight line with use of a recording head having staggered nozzles.
Figure 13B:
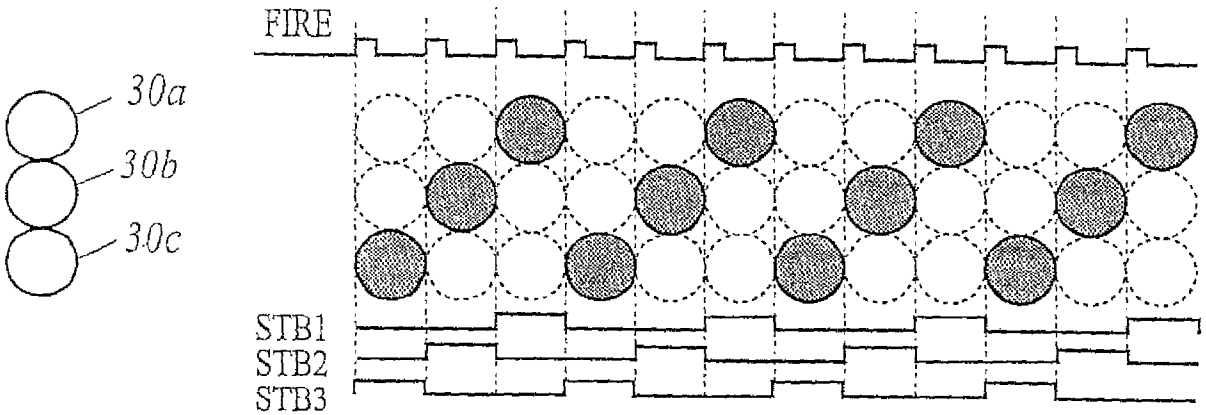
FIG 13B PRIOR ART
FIG. 13B illustrates drive phases in case that multi-pass recording is performed.

As shown in FIG. 6A, the head drive units 8*a*-8*d* apply pulse voltages from a drive signal generation unit 80, on the basis of the image data, to the jetting elements 8*e*-8*h* of the nozzles for drive phases set by the phase setting units 73, . . . to thereby cause the nozzles 30, . . . to jet inks. With this ink jetting, as shown in FIG. 13B described before, inks are deposited on the lines with one pixel shifted in the scanning direction X for every phase. In more detail, as shown in FIG. 4B and FIG. 7, if a line, nearest to the record starting position out of lines in the conveying direction Y on the medium P, is denoted as a first line, the inks jetted from nozzles 30A, . . . are deposited on (3*n*-2)th lines, the inks from nozzles 30B, . . . on (3*n*-1)th lines, and the inks from nozzles 30C on 3*n*-th lines. At this time, if a line corresponding to the nozzle of number "1" out of lines in the scanning direction X is denoted as a first line, the inks jetted from nozzles 30A, . . . are deposited on (3*n*-2)th lines, the inks from nozzles 30B, . . . on (3*n*-1)th lines, and the inks from nozzles 30C on 3*n*-th lines.

Further, the irradiating device 4 cures the inks on the recording medium P by irradiation of ultraviolet rays (step S4, irradiating step).

Next, after the conveying device 11 transports the medium P by 5 pixels in the conveying direction Y, the carriage 2 performs second scanning (step S1, moving step). During this scanning, the recording heads 3*a* to 3*d* jet inks as in the first scanning, and the irradiating device 4 irradiates ultraviolet rays.

Thereafter, the inkjet recording apparatus 1 repeats the steps described above, whereby allover images are sequentially recorded on the surface of the medium P as shown at the right end of FIG. 7.

According to the inkjet recording method described above, the relationship between the positions of a nozzle line L in the scanning direction X and the drive phases of the nozzle line L can be surely matched each other among the nozzle lines L, . . . , so that relative positional relationship of dots formed by the nozzle lines L, . . . can be correctly represented in the scanning direction X. Further, positional deviation of dots caused by the displacement of nozzle-line positions in the scanning direction X can be compensated, so that dot-forming positions match each other among the nozzle lines L . . . in the scanning direction X. Therefore, image quality can be improved compared with the prior one.

Further, the multi-pass recording method with a multi-phase drive method can reduce the load of drive circuits for the recording heads 3*a*-3*d*. Additionally, being different from prior recording apparatus having staggered nozzles, the image recording speed can be improved to the extent that the scanning speed is not limited by the number of drive phases and the staggered pitch of nozzles 30 . . . .

As a result, images can be recorded with higher quality at higher speed than prior ones.

Figure 8A:
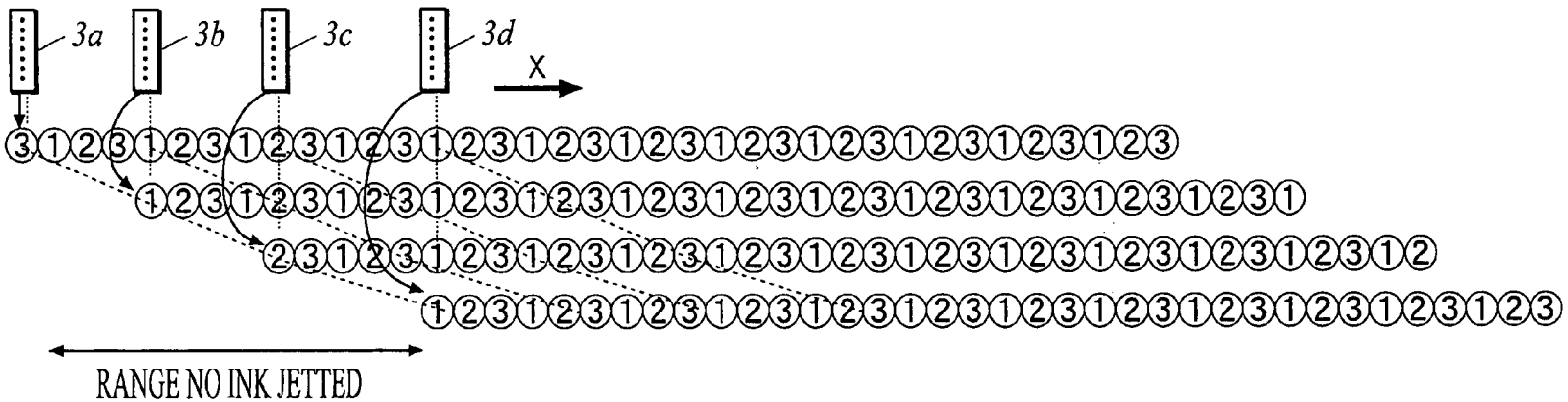
FIG. 8A illustrates drive phases for each nozzle line.
Figure 8B:
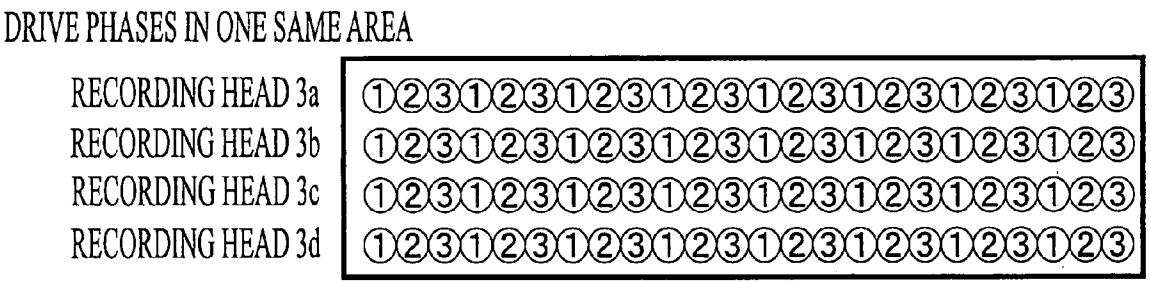
FIG. 8B illustrates the drive phases for nozzle lines in one same recording area.

In the embodiment described above, the mutual spaces between adjacent nozzle lines L and L among nozzle lines L . . . of the recording heads 3*a*-3*d* are all assumed to be 4 pixels, but it may be spaced apart by other number of pixels. For instance, as shown in FIG. 8A, in case that a space between the nozzle line L of the head 3*c* and that of the head 3*d* is set to 5 pixels, when the carriage 2 moves from left side to the right side of the recording medium P of FIG. 1, ink jet timings for the recording heads 3*c*, 3*b* and 3*a* are delayed by 5 pixels, 9 pixels and 13 pixels, respectively, relative to that of the nozzle line L of the head 3*d*, so that ink-jet positions in the scanning direction X match each other among the nozzle lines L . . . . In this case, by setting, for the recording head 3*d*, the starting drive phase to "1" and the phase order to "1", "2" and "3", for the head 3*c* to "2" and the phase order "2", "3" and "1", for the head 3*b* to "1" and the phase order "1", "2" and "3", and for the head 3*a* to "3" and the phase order "3", "1" and "2", the relationship between positions of a nozzle line L in the scanning direction X and drive phases of the nozzle line L, as shown in FIG. 8B, can be matched each other among the nozzle lines L, . . . . Thus, by controlling, for the recording heads 3*a*-3*d*, the ink jet timings, the starting drive phases and the phase orders, respectively, the ink-jet positions in the scanning direction X, the relationship between positions of a nozzle line L in the scanning direction X and drive phases of the nozzle line L can be matched each other among the nozzle lines L, . . . , irrelevant to the spaces among nozzle lines L, . . . .

Figure 5C:
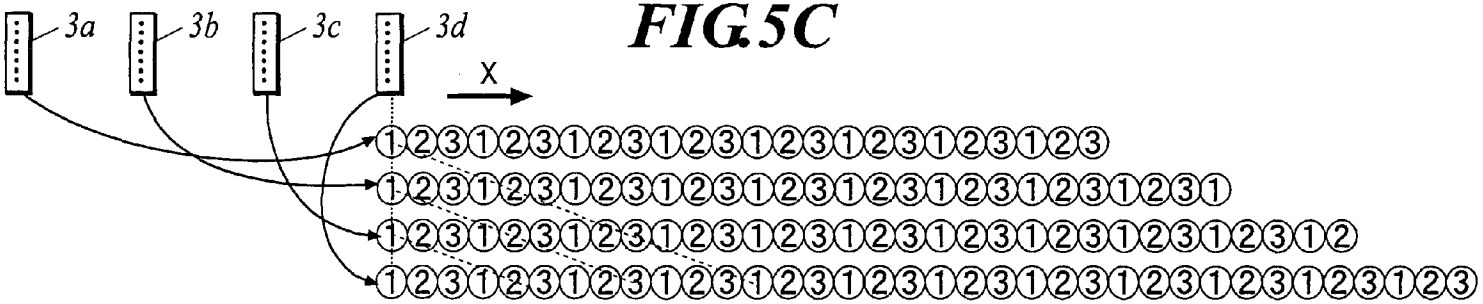
FIG. 5C illustrates setting timings of starting drive phases.

The phase setting units 73 set the starting drive phases for respective nozzle lines L . . . at the same timing in the embodiment, but, as shown in FIG. 5C, they may be set at different timings, if they are prior to the ink jet timings adjusted by the counter units 71. In FIG. 5C, the starting drive phases are set to "1" at the timings that the nozzle lines L . . . reach the edge of the recording medium P.

The nozzle lines L of the recording heads 3*a*-3*d* are driven by 3 phases in the embodiment, however, the nozzle lines may be driven by other number of phases than 3 phases, for example, 2 phases or 4 phases.

As to the ink, ultraviolet curable ink is used in the embodiment, but there may be used such ink that is cured by the light having other wavelength than ultraviolet rays. In this case, as a light source of the irradiating device 4, there may be employed, for example, a fluorescent lamp radiating electron beam, X rays, visible rays, infrared rays and the like, a mercury lamp, a metal halide lamp or the like.

Second Embodiment

Next, a second embodiment according to the invention will be explained. Those elements that are the same as corresponding elements in the first embodiment are designated by the same reference numerals and the description thereof will be omitted.

Figure 9A:
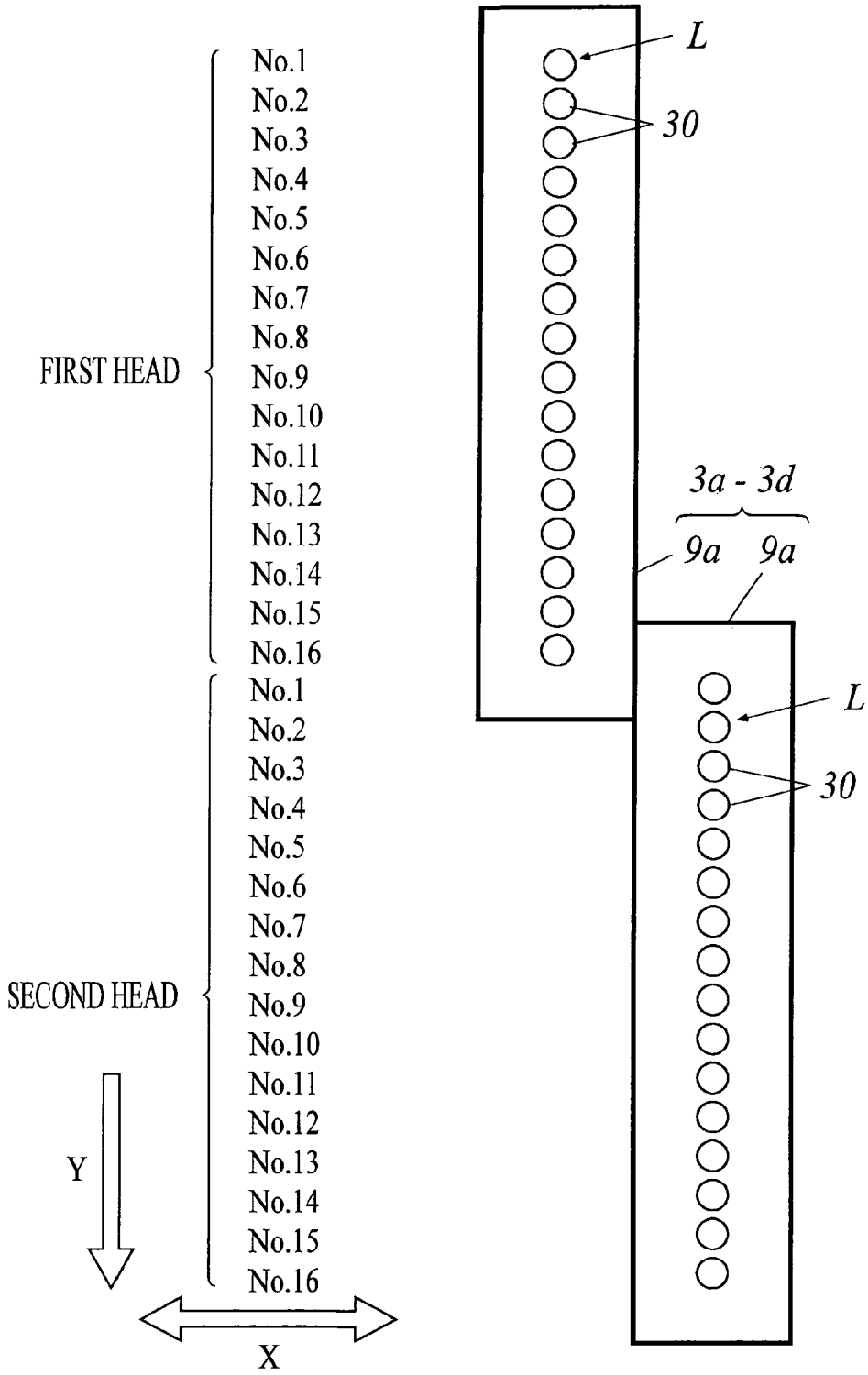
FIG. 9A is a bottom view of a recording head.

Each of recording heads 3*a* to 3*d* on an inkjet recording apparatus 1A according to the second embodiment of the invention has, as shown in FIG. 9A, a first head 9*a* arranged at the upstream side in the conveying direction Y and a second head 9*b* arranged at the downstream side.

Each of the first head 9*a* and the second head 9*b* has a nozzle line L, which has 16 nozzles in the embodiment. The space between the nozzle lines L and L in the scanning direction X is, for example, one pixel-width.

Nozzles 30 . . . in these nozzle lines L and L have, as shown in FIG. 9B, 3 phases of phase channels allotted thereto. To be concrete, a phase channel "A" is set to nozzles 30A, . . . having nozzle numbers 3*n*-2, a channel "B" to nozzles 30B, . . . having nozzle numbers 3*n*-1, and a channel "C" to nozzles 30C, . . . having nozzle numbers 3*n*.

The phase setting units 73 in the embodiment set relationship between the phase channels and the drive phases for nozzle groups of the first head 9*a* such that, a nozzle group of phase channel "A" is driven by drive phase "1", a group of "B" by drive phase "2", and a group of "C" by drive phase "3".

The phase setting units 73 also set the relationship between the phase channels and the drive phases for nozzle groups of the second head 9*b* such that, a nozzle group of phase channel "A" is driven by drive phase "2", a group of "B" by drive phase "3", and a group of "C" by drive phase "1".

Figure 10:
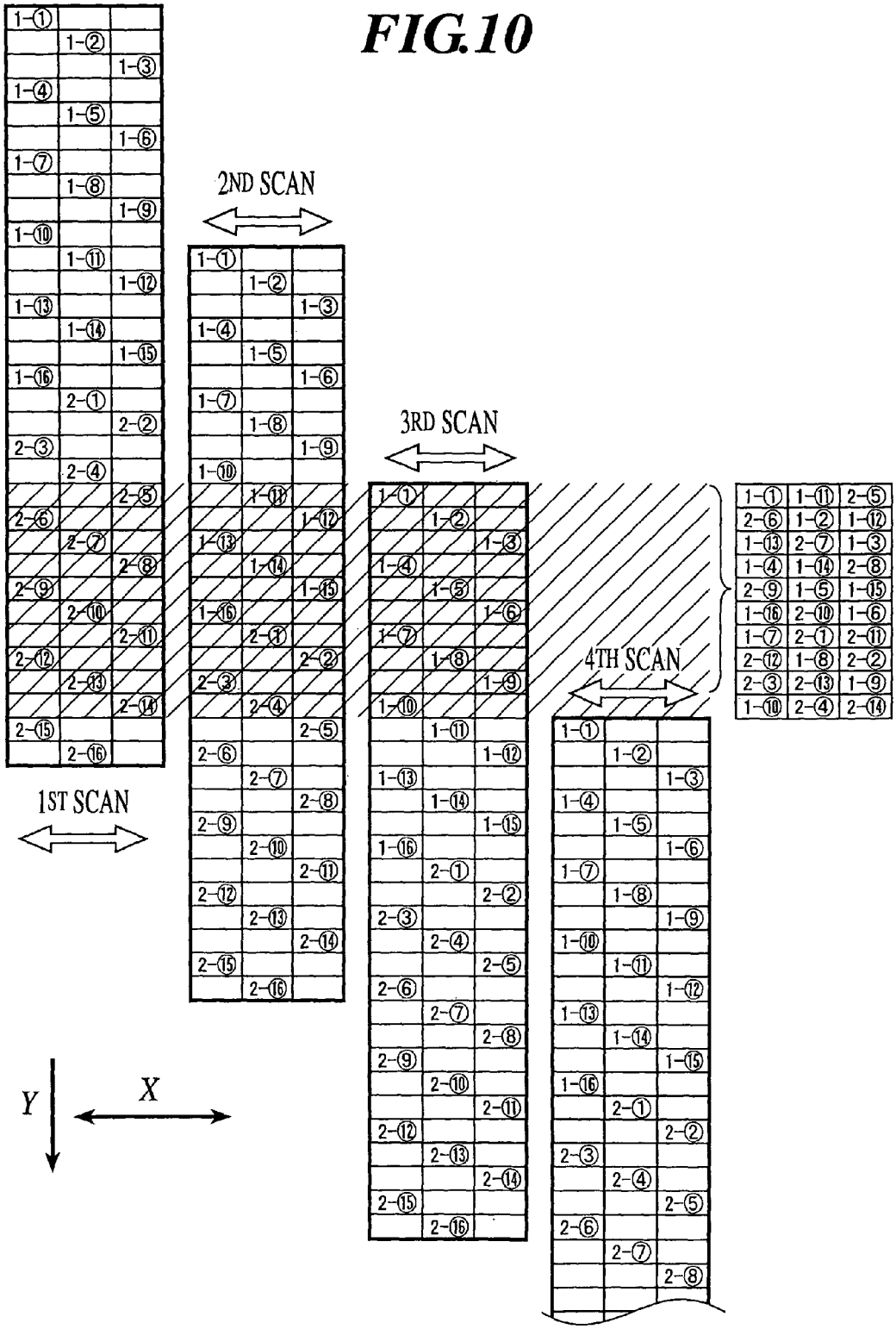
FIG. 10 is a diagram showing a recorded image in case that a multi-pass recording is performed by using the recording head of FIGS. 9A and 9B.

In such inkjet recording apparatus 1A, if recording of an allover image is performed, for example, with the phase order of nozzle lines L and L set to "1", "2" and "3", and with the medium P transported by 10 pixels between each scanning, the allover image is recorded on the surface of the medium P, as shown in FIG. 10.

According to the inkjet recording apparatus 1A described above, the phase control section 7 controls drive phases such that the relationship between the phase channels and the drive phases are set different between the first head 9*a* and the second head 9*b*, so that the relationship between the positions of a nozzle line L in the scanning direction X and the drive phases of the nozzle line L can be surely matched each other among the nozzle lines L, . . . . As a result, relative positional relationships among dots formed by the nozzle lines L, . . . can be correctly represented in the scanning direction X. Further, positional deviation of dots caused by the displacement of nozzle-line positions in the scanning direction X can be compensated, so that dot-forming positions match each other among the nozzle lines L . . . in the scanning direction X. Also, dot spaces recorded by each drive phase can be arranged constantly in the conveying direction Y. That is, relative positional relationships among dots formed by the nozzle lines L and L can be correctly represented in the conveying direction Y. Therefore, image quality can be improved compared with the prior one.

Further, the multi-pass recording system can reduce the load of drive circuits for the recording heads 3*a*-3*d*. Additionally, being different from prior recording apparatus having staggered nozzles, the image recording speed can be improved to the extent that the scanning speed is not limited by the number of drive phases and the staggered pitch of nozzles 30, . . . .

As a result, images can be recorded with higher quality at higher speed than prior ones.

Third Embodiment

A third embodiment according to the invention will now be explained. Those elements that are the same as corresponding elements in the first embodiment are designated by the same reference numerals and the description thereof will be omitted.

Figures 11A, 11B:
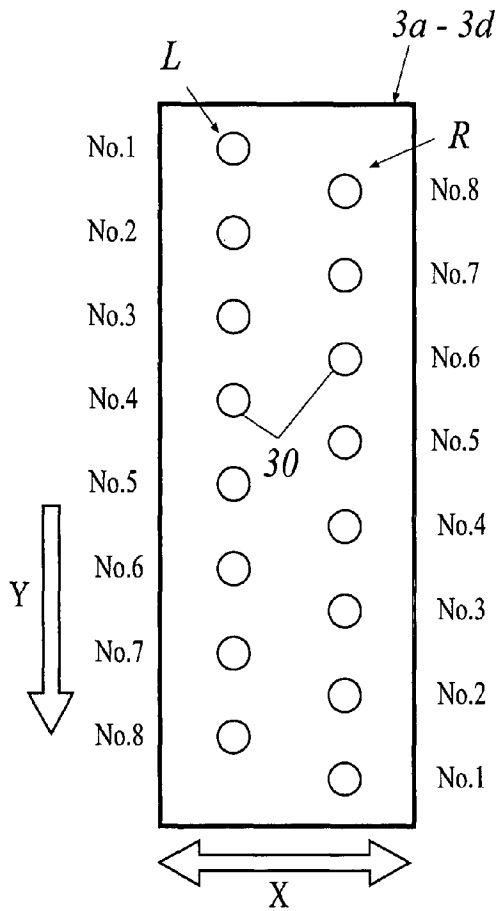
FIG. 11A is a bottom view of a recording head.
FIG. 11B is a diagram showing the relationship between nozzle numbers and drive phases.
Figure 12:
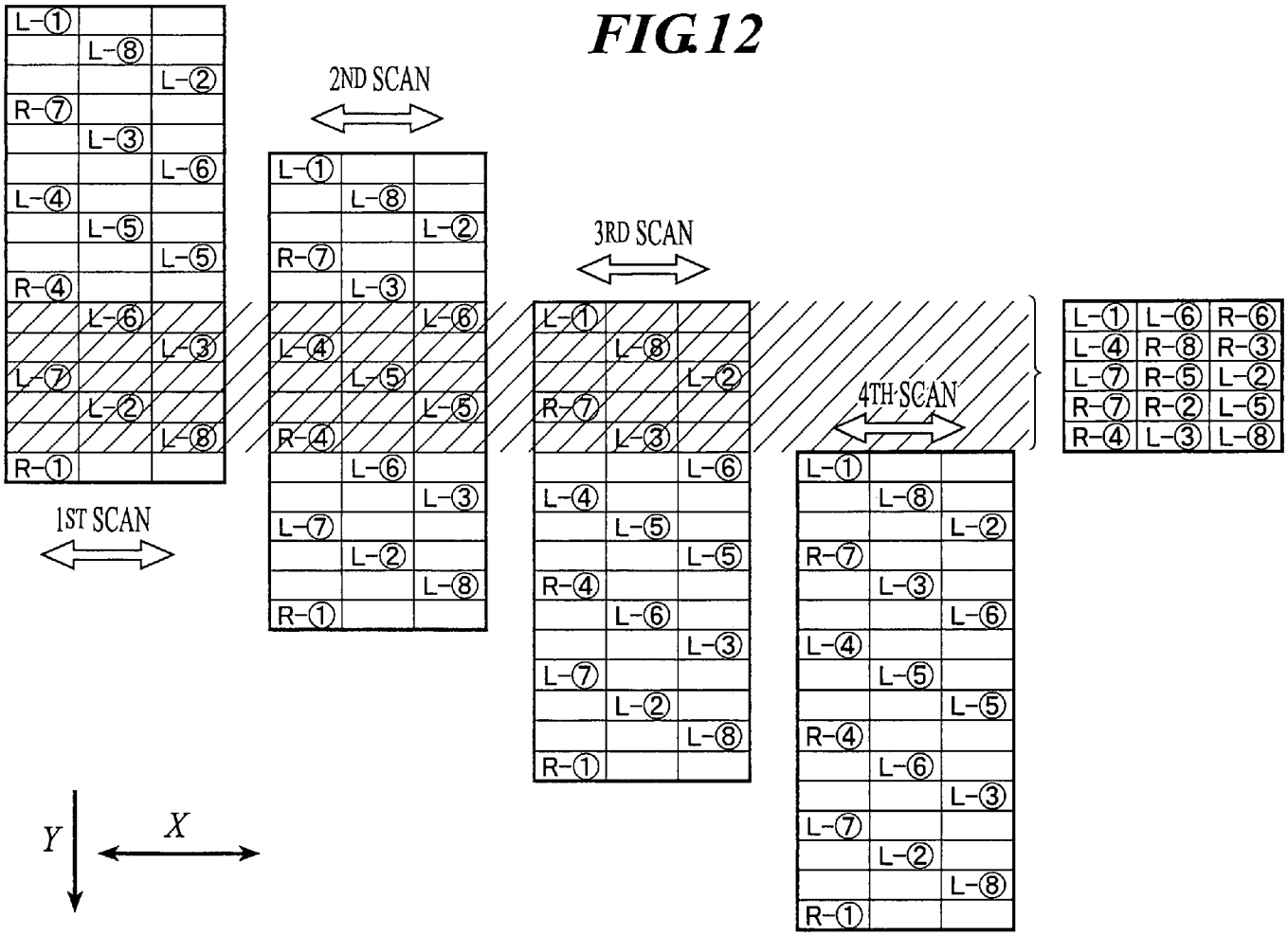
FIG. 12 is a diagram showing a recorded image in case that a multi-pass recording is performed by using the recording head of FIGS. 11A and 11B.

Each of recording heads 3*a*-3*d* on an inkjet recording apparatus 1B according to the third embodiment has two nozzle lines L and L, as shown in FIG. 11A.

In the embodiment, each nozzle line L has 8 nozzles. The space between the nozzle lines L and L in the scanning direction X is, for example, one pixel width.

Nozzles 30 . . . on the nozzle line L at the left side in the drawing (hereinafter, "left-side nozzle line L") are set nozzle numbers from 1 in due order from the upstream side toward the downstream side in the conveying direction Y, and nozzles 30, . . . on the nozzle line L at the right side in the drawing (hereinafter, "right-side nozzle line L") are set nozzle numbers from 1 in due order from the downstream side toward the upstream side in the conveying direction Y.

Nozzles 30, . . . in these nozzle lines L and L have, as shown in FIG. 11B, 3 phases of phase channels allotted thereto. To be concrete, a phase channel "A" is set to nozzles 30A, . . . having nozzle numbers 3*n*-2, a channel "B" to nozzles 30B, . . . having nozzle numbers 3*n*-1, and a channel "C" to nozzles 30C, . . . having nozzle numbers 3*n*.

The phase setting units 73 in the embodiment set relationship between the phase channels and the drive phases for nozzle groups of the left-side nozzle line L such that, a nozzle group of phase channel "A" is driven by drive phase "1", a group of "B" by drive phase "3", and a group of "C" by drive phase "2".

The phase setting units 73 also set the relationship between the phase channels and the drive phases for nozzle groups of the right-side nozzle line L such that, a nozzle group of phase channel "A" is driven by drive phase "1", a group of "B" by drive phase "2", and a group of "C" by drive phase "3".

In such inkjet recording apparatus 1B, if recording of an allover image is performed, for example, with the phase order set to "1", "2" and "3", and with the medium P transported by 5 pixels between each scanning, the allover image is recorded on the surface of the medium P, as shown in FIG. 11.

According to the inkjet recording apparatus 1B described above, the phase control section 7 controls drive phases such that the relationship between the phase channels and the drive phases are set different between the left-side nozzle line L and the right-side nozzle line L, so that the relationship between the positions of a nozzle line L in the scanning direction X and the drive phases of the nozzle line L can be surely matched each other among the nozzle lines L, . . . . As a result, relative positional relationships among dots formed by the nozzle lines L, . . . can be correctly represented in the scanning direction X. Further, positional deviation of dots caused by the displacement of nozzle-line positions in the scanning direction X can be compensated, so that dot-forming positions match each other among the nozzle lines L, . . . in the scanning direction X. Also, dot spaces recorded by each drive phase can be arranged constantly in the conveying direction Y. That is, relative positional relationships among dots formed by the nozzle lines L and L can be correctly represented in the conveying direction Y. Therefore, image quality can be improved compared with the prior one.

Further, the multi-pass recording system can reduce the load of drive circuits for the recording heads 3*a*-3*d*. Additionally, being different from prior recording apparatus having staggered nozzles, the image recording speed can be improved to the extent that the scanning speed is not limited by the number of drive phases and the staggered pitch of nozzles 30, . . . .

As a result, images can be recorded with higher quality at higher speed than prior ones.

The entire disclosure of Japanese Patent Application No. 2004-234719 which was filed on Aug. 20, 2004, including specification, claims, drawings and abstract, is incorporated into the present invention in its entirety.

What is claimed is:

1. An inkjet recording apparatus comprising:

at least one recording head unit having a plurality of nozzle lines each having a plurality of nozzles driven with multi-phase drive;

a moving unit to move the recording head unit by predetermined times in a main scanning direction crossing the nozzle lines in an area facing one same recording area on a recording medium;

a clock generating unit to generate clock signals using an electric signal generated according to moving amount of the recording head; and a recording head control section to control the recording head unit, the recording head control section including a phase control section to control each drive phase of the plurality of nozzle lines on the basis of the clock signals, and the phase control section comprises phase setting units to switch the drive phases of the plurality of nozzle lines in predetermined phase orders in synchronization with the clock signals;

wherein the recording head control section controls the recording head unit such that, by driving the nozzle lines with the drive phases controlled by the phase control section during movement of the recording head unit by the moving unit, an image is recorded with a plurality of pixels reduced by a predetermined reduced pattern in the main scanning direction, and with predetermined times of repetition of this recording, an image recording in the recording area is completed.

2. The inkjet recording apparatus of claim 1, wherein the phase control section comprises: space memory units to store spaces of the plurality of nozzle lines; and a timing adjusting unit to adjust ink-jet timing among the plurality of nozzle lines on the basis of the clock signals and the spaces.

3. The inkjet recording apparatus of claim 1, wherein the phase control section comprises starting phase memory units to store starting drive phases specific to respective nozzle lines as starting drive phases of the plurality of nozzle lines, and wherein the phase setting units set respective starting drive phase stored in the starting phase memory units as the starting drive phases of respective nozzle lines.

4. The inkjet recording apparatus of claim 1, wherein the phase control section comprises phase order memory units to store phase orders specific to respective nozzle lines as the predetermined phase orders, and the phase setting units switch the drive phases of respective nozzle lines on the basis of the predetermined phase orders stored in the phase order memory units.

5. The inkjet recording apparatus of claim 1, further comprising an irradiating device to irradiate light toward an ink deposited on the recording medium, wherein the recording head unit jets photo-curable ink.

6. The inkjet recording apparatus of claim 5, wherein the irradiating device irradiates ultraviolet rays, and the recording head unit jets ultraviolet curable ink.

7. The inkjet recording apparatus of claim 5, wherein the ink is cationic polymerization type ink.

8. An inkjet recording method comprising:

moving at least one recording head unit having a plurality of nozzle lines each having a plurality of nozzles driven with multi-phase drive, by predetermined times in a main scanning direction crossing the nozzle lines in an area facing one same recording area on a recording medium;

generating clock signals using an electric signal generated according to moving amount of the recording head; and controlling the recording head unit, which includes controlling each drive phase of the plurality of nozzle lines on the basis of the clock signals, wherein in the controlling the recording head unit, by driving the nozzle lines with the drive phases controlled to switch the drive phases of the plurality of nozzle lines in predetermined phase orders in synchronization with the clock signals by the phase control section during movement of the recording head unit by the moving unit, an image is recorded with a plurality of pixels reduced by a predetermined reduced pattern in the main scanning direction, and with predetermined times of repetition of this recording, an image recording in the recording area is completed.

9. The inkjet recording method of claim 8, wherein the controlling each drive phase of the plurality of nozzle lines comprises adjusting ink-jet timing among the plurality of nozzle lines on the basis of spaces of the plurality of nozzle lines and the clock signals.

10. The inkjet recording method of claim 8, wherein starting drive phases specific to the plurality of nozzle lines are used as starting drive phases of the plurality of nozzle lines.

11. The inkjet recording method of claim 8, wherein as the predetermined phase orders, phase orders specific to respective nozzle lines are used.

12. The inkjet recording method of claim 8, further comprising irradiating light toward inks deposited on the recording medium, wherein the recording head unit jets photo-curable ink.

13. The inkjet recording method of claim 12, wherein the recording head unit jets ultraviolet curable ink and ultraviolet rays are used as the light.

14. The inkjet recording method of claim 12, wherein cationic polymerization type ink is used as the ink.

* * * * *